United States Patent [19]

Kiyonari et al.

[11] Patent Number: 5,035,983

[45] Date of Patent: Jul. 30, 1991

[54] METHOD AND COMPOSITION FOR LASER-MARKING

[75] Inventors: Toshiyuki Kiyonari, Urawa; Satoshi Hirabayashi, Omiya; Naoto Kidokoro, Ageo, all of Japan

[73] Assignee: Dainippon Ink and Chemicals, Inc., Tokyo, Japan

[21] Appl. No.: 359,638

[22] Filed: May 31, 1989

[30] Foreign Application Priority Data

May 31, 1988 [JP] Japan ..... 63-134107
Nov. 17, 1988 [JP] Japan ..... 63-290605

[51] Int. Cl.[5] ..... G03C 1/28; G03C 5/00

[52] U.S. Cl. ..... 430/346; 430/270; 430/495; 430/945; 430/947; 346/76 L; 346/135.1

[58] Field of Search ..... 430/270, 346, 495, 945, 430/947; 346/76 L, 135.1

[56] References Cited

U.S. PATENT DOCUMENTS 4,341,863 7/1982 Borrelli et al. ..... 430/495

FOREIGN PATENT DOCUMENTS 0036680 9/1981 European Pat. Off. .
0111357 6/1984 European Pat. Off. .

OTHER PUBLICATIONS

The Japanese Abstracts of Japan, vol. 13, No. 542, (JP-A-01222995).
The Patent Abstracts of Japan, vol. 13, No. 542, (JP-A-01222994).

*Primary Examiner*—Charles L. Bowers, Jr.
*Assistant Examiner*—Ashley I. Pezzner
*Attorney, Agent, or Firm*—Sherman and Shalloway

[57] ABSTRACT

A laser-marking composition characterized by containing a non-black inorganic lead compound and a resin and a laser-marking method characterized by marking the surface of an object comprising said composition by exposure to laser beams having wavelengths falling in the far infrared regions.

7 Claims, No Drawings

METHOD AND COMPOSITION FOR LASER-MARKING

DESCRIPTION OF THE PRIOR ART

The present invention relates to a method for effecting a black marking by means of laser beams having wavelengths falling in the far infrared region and to a marking composition suitable for providing the marking by this method.

Field of the Invention

Laser-marking is a technique for marking a mark, bar bord, image and the like by means of laser beams on the surface of a metal, ceramic, high molecular weight organic material or the like, and recently it has been utilized industrially in a wide range because of being non-contact, fast in marking rate, and easy to automate and to control processes.

In laser-marking the marking is effected by exposing the surface of objects to laser beams, utilizing (1) the changing of surface condition (roughening or concaving) by etching of the exposed part, (2) the changing caused by the decoloration or discoloration of coloring agent present in the exposed part (see, for instance, Japanese Laid-Open Patent Application No. 155493/85 and U.S. Pat. No. 4401792,) or (3) the changing of the exposed part due to the decomposition of a laser absorbing substance-containing high molecular weight organic material (such, for instance, as material hard to provide a marking only by laser, such as polyolefin resin)(see, for instance, U.S. Pat. No. 4578329).

However, the method of (1) entails the defect that the contrast between the exposed part and the unexposed part to laser beams is so faint that a high energy of laser beam radiation is necessary to provide a clear mark. The method of (2) above because of the restriction on usable coloring agents, the color of the substrate is limited, or because of lower heat resistance of the coloring agent, the whole substrate tends to be discolored to the same color in the laser beam exposed part, and in the method of (3) above usable high molecular weight organic materials are limited (surface roughening alone takes place in other high molecular weight organic materials without causing decomposition enough for marking and hence, marking is rendered unclear).

Further, a method for marking a high molecular weight organic material containing a pigment and/or polymer-soluble dyestuff by means of laser beams having wavelengths falling in the near-ultraviolet region and/or visible and/or near-infrared region is disclosed in Japanese Laid-Open Patent Application KOKAI No. 192737/86. However, high output laser devices usable in this method are higher in costs as well as in running costs and what is more, by this method it is impossible to provide a clear and highly visible black marking.

SUMMARY OF THE INVENTION

A method and composition is provided for laser marking the surface of an object with laser light having wavelengths falling in the far infrared region. A composition susceptible to such laser marking comprises a non-black inorganic lead compound, a resin, and at least one compound selected from the group consisting of inorganic boric acid compounds, inorganic phosphoric acid compounds, and inorganic silicic acid compounds. This composition can be used in forming a molded article or it can be applied as a coating to the surface to be marked.

DESCRIPTION OF PREFERRED EMBODIMENT

According to the present invention it was found that objects comprising a composition containing a nonblack inorganic lead compound and a resin can readily provide a clear and highly visible black marking only by exposing its surface to laser beams having wavelengths falling in the far infrared region, that because of excellent heat resistance of the lead compound the objects are hardly discolored to black by heating, and that because of non-black of the lead compound the objects can be colored in an optional color with coloring agents. It was also found that when at least one compound, which functions as a sensitizer, and which is selected from inorganic boric acid compounds, inorganic phosphoric acid compounds and inorganic silicic acid compounds, together with the non-black inorganic lead compound, are incorporated in the resin, a clear and highly visible black marking is provided even by lower energy laser beam radiation.

Thus, according to the present invention, there are provided a laser marking method characterized by providing a marking by exposing the surface of objects containing a non-black inorganic lead compound and a resin to laser beams having wavelengths falling in the far infrared region. There is also provided a lasermarking composition comprising a nonblack inorganic lead compound, a resin and at least one compound selected from inorganic boric acid compounds, inorganic phosphoric acid compounds, and inorganic silicic acid compounds.

For the laser used in the present invention it is sufficient to radiate laser beams having wavelengths falling in the far infrared region. Suitable lasers are for instance, a carbon dioxide gas laser, carbon monoxide laser, semi-conductor laser and the like, and usually those which are 5 to 15 micrometers in wavelength and preferably those which are 8 to 12 micrometers in wavelength, can be employed. More specifically carbon dioxide gas lasers with a wavelength of 10.6 micrometers, such as Transversely Excited Atmospheric Pressure (TEA) type carbon dioxide gas lasers and scanning type (continuously oscillating or pulse oscillating) carbon dioxide gas lasers, are more preferred. As the devices there are cited, for instance, devices which are capable of laser beam radiation of 1 to 200 times/sec. in a pulse duration time of 0.1 to 10 microseconds at 0.5 to 20 Joule/pulse output for the TEA type carbon dioxide gas lasers and devices which are 0.5 to 20000 W in output and 2 to 10 kHz in pulse interval in the case of pulse oscillation for the scanning type (continuously oscillating or pulse oscillating) carbon dioxide gas lasers.

As the inorganic lead compound used in the present invention there are cited, for instance, lead sulfate, basic lead sulfate, lead sulfite, basic lead sulfite, lead phosphite, basic lead phosphite, lead hydroxide, lead carbonate, basic lead carbonate, lead nitrate, lead chloride, lead subcarbonate, lead titanate, lead zirconate, lead chromate, basic lead chromate, lead tungstate, lead type glass and the like, and these compounds may contain crystal water. Further, these may be used either singly or in admixture of 2 or more members or as coprecipitates or complex salts. Moreover, of these, basic lead phosphite, basic lead sulfite and basic lead carbonate are preferred in terms of good black visibility.

As the composition containing the non-black inorganic lead compound and the resin used in the present invention there are cited, for instance, a molding material, coating composition and the like obtained by incorporating the inorganic lead compound into the resin. Furthermore, as the objects comprising this composition there are cited, for instance, shaped articles obtained by molding said molding material and films obtained by coating and drying or curing said coating composition.

The content of the inorganic lead compound is not predetermined and varies according to the kind and use of said composition, but it is usually contained in the range of 2 to 95% by weight in the objects (such as shaped articles and films) comprising said composition. Particularly, its content should preferably range from 7 to 60% by weight in terms of providing a clear and highly visible black marking and of minimizing a reduction of physical properties of the shaped articles or coated products.

As the inorganic boric acid compound used as the sensitizer for laser beams there are cited, for instance, zinc borate, aluminum borate, ammonium borate, manganese borate, magnesium borate, lithium borate, copper borate, cobalt borate, sodium borate, calcium borate, potassium borate, barium borate, boric acid type glass, magnesium metaborate, sodium metaborate, lithium metaborate, calcium metaborate and the like, and particularly zinc borate, calcium borate, sodium metaborate and boric acid type glass are more preferred.

As the inorganic phosphoric acid compound there are cited, for instance, zinc phosphate, aluminum phosphate, ammonium phosphate, monomanganese phosphate, dimanganese phosphate, trimanganese phosphate, monomagnesium phosphate, dimagnesium phosphate, trimagnesium phosphate, ferric phosphate, cupric phosphate, titanium phosphate, cobalt phosphate, monosodium phosphate, disodium phosphate, trisodium phosphate, zirconium phosphate, strontium phosphate, monocalcium phosphate, dicalcium phosphate, tricalcium phosphate, cadmium phosphate, nickel phosphate, barium phosphate, lithium phosphate, ammonium manganese phosphate, ammonium cobalt phosphate, potassium metaphosphate, sodium metaphosphate, lithium metaphosphate, barium metaphosphate, calcium metaphosphate, tin metaphosphate, phosphoric acid type glass and the like, and particularly zinc phosphate, dimagnesium phosphate, trimagnesium phosphate, dicalcium phosphate, ammonium phosphate and phosphoric acid type glass are more preferred.

As the inorganic silicic acid compound there are cited silica, aluminum silicates (such as kaolin, clay, bentonite, mica and the like), silicates of alkali metal and alkaline earth metal oxides (such as asbestos, talc, calcium silicate and the like), silica type glass and the like, and particularly silica, kaolin, clay, mica, asbestos, calcium silicate and silica type glass are more preferred.

Further, these inorganic boric acid compounds, inorganic phosphoric acid compounds, and inorganic silicic acid compounds may contain crystal water and, moreover, they may form complex salts. Not only that, but these inorganic boric acid compounds, inorganic phosphoric acid compounds and inorganic silicic acid compounds may be used either singly or in admixture of 2 or more members.

The inorganic boric acid compound, inorganic phosphoric acid compounds and inorganic silicic acid compound are present in amounts of 2% by weight or more in objects (such as shaped articles and films) containing the non-black inorganic lead compound, and total content and the inorganic lead compound falls in the range of 95% by weight or less. Specifically the content of the inorganic phosphoric acid, boric acid, and silicic acid compounds preferably falls in the range of 5 to 50% by weight, and their total content and the inorganic lead compound falls in the range of 70% by weight or less in terms of providing a clear and highly visible black marking, and of causing less lowering of physical properties of shaped articles or coated products.

Further, the inorganic lead compound, inorganic boric acid compound, inorganic phosphoric acid compound and inorganic silicic acid compound may also be subjected to surface-treatment with fatty acid metal salts or a coupling agent of silicon derivative, titanous derivative or aluminous derivative.

In the present invention the principle of discoloration to black is not based on the carbonization of the organic material and hence, no limitations are imposed on resins usable for obtaining the composition containing the non-black inorganic lead compound.

As the resin used for the molding material there are cited, for instance, thermoplastic resins and thermo-setting resins capable of extrusion molding, transfer molding, injection molding, blow molding, cast molding, press molding, tape molding and the like. Examples of such thermoplastic resins are polyolefinic resins, vinyl chloride type resins, polystyrenic resins, acrylonitrile/butadiene/styrene type resins, acrylic resins, polyvinyl alcohol type resins, polyester type resins, polycarbonate type resins, polyacetal type resins, polyphenylene sulfide type resins, polyether type resins, polyamide type resins, polyimide type resins, fluorine type resins and the like, and examples of such thermo-setting resins are epoxy type resins, phenolic resins, amino resins, polyester type resins, polyether type resins, acrylic resins, diallyl phthalate type resins, urethanic resins, aniline type resins, furan type resins, polyimide type resins, silicone type resins, fluorine type resins and the like. These may be used singly or by mixing or copolymerizing 2 or more members.

The resin used for the coating composition is not specifically limited for a specific type, and it is sufficient to be capable of brush coating, spray coating, dip coating, gravure coating, doctor coating, roll coating, electrostatic coating, powder coating, transferring, printing and the like. To illustrate for every curing form, as normal temperature curing type coating resins, moisture curing type coating resins and thermo-setting coating resins there are cited oil varnish, boiled oil, shellac, cellulosic resins, phenolic resins, alkyd type resins, amino resins, xylene resins, toluene resins, vinyl chloride type resins, vinylidene chloride type resins, vinyl acetate type resins, polystyrenic resins, vinylbutyral type resins, acrylic resins, diallyl phthalate type resins, epoxy type resins, urethanic resins, polyester type resins, polyether type resins, aniline type resins, furan type resins polyimide type resins, silicone type resins, fluorine type resins and the like, and as photo-curing type resins and electron beam curing type resins there are cited polyvinyl cinnamic acid ester type resins, polyvinyl benzalacetophenone type resins, polyvinyl styrylpyridine type resins, polyvinyl anthral type resins, unsaturated polyester type resins, acrylated oil, acrylated alkyd type resins, acrylated polyester type resins, acrylated polyether type resins, acrylated epoxy type resins, acrylated polyurethane type resins, acrylic resins, acrylated spirane type resins, acrylated silicone type resins, acrylated fluorine type resins, polythiol type resins and macromers, oligomers and monomers of cation polymerization type epoxy type resins. These may be used singly or by mixing or copolymerizing 2 or more members.

Further, additives or solvents may optionally be added to the resins used for the molding material and coating composition. As the additives there may be used in usually-added amounts those additives used in usual resin molding or resin coating, such as curing agent (such as amine type curing agent, acid anhydride type curing agent, peroxide type curing agent and the like), desiccant (such as cobalt naphthenate, calcium naphthenate and the like), cross-linking agent, photo-initiator (such as the acetophenone type, benzophenone type, Michler's ketone type, benzyl type, benzoin type, thioxanthone type and the like), photo-sensitizer (such as the butylamine type, triethylamine, diethylaminoethylmethacrylate and the like), polymerization inhibitor (such as hydroquinone, benzoquinone and sodium carbamate type compound and the like), dispersant (such as metallic soap, surface active agent and the like), flowability controller (such as metallic soap, bentonite, polymerized oil, sodium alginate, casein, aerosil, organix typeinorganic type fine particles and the like), precipitation preventor (such as lecithin and the like), flame retardant (such as antimony trioxide, phosphate ester, chlorine type and bromine type flame retardant and the like), lubricant or mold releasing agent (such as paraffinic wax, polyethylenic wax, montan wax, fatty acid, fatty acid amide, fatty acid ester, aliphatic alcohol, partial ester of fatty acid and polyhydric alcohol, surface active agent, silicone type compound, fluorine type compound and the like), plasticizer (such as phthalic acid derivative, adipic acid derivative, sebacic acid derivative, trimellitic acid derivative, epoxy derivative, fatty acid derivative, organic phosphoric acid derivative and the like), stabilizer (such as metallic soap, organotin type, phosphite ester type compound and the like), antioxidant (such as naphthylamine type, diphenylamine type, quinoline type, phenol type and phosphite ester type compounds and the like), ultraviolet absorber (such as salicylic acid derivative, benzophenone type, benzotriazole type and hindered amine type compounds and the like), reinforcing agent (such as glass fiber, carbon fiber, ceramic fiber or whisker and the like) and coloring agent (such as inorganic pigment, organic pigment, dyestuff and the like).

In order to obtain a composition comprising a non-black inorganic lead compound and a resin and optionally at least one compound selected from inorganic boric acid compounds, inorganic phosphoric acid compounds and inorganic silicic acid compounds, additives, solvents and the like, it is sufficient to mix them in an optional manner. In the case, however, of using 2 or more inorganic lead compounds and in the case of joint use of at least one compound selected from inorganic boric acid compounds, inorganic phosphoric acid compounds and inorganic silicic acid compounds, they should preferably be used as a mixture obtained by uniformly premixing them. Such a mixture can readily be prepared by mechanical mixing methods using a ball mill, vibration mill, attriter, roll mill, high speed mixer and the like or by chemical or physical mixing methods, such as coprecipitation method, microcapsulation method, chemical vapor deposition method, physical vapor deposition method and the like.

As the method for laser-marking there are cited, for instance, a method of scanning a laser beam on the surface of objects by making it a spot of a suitable size, a method of exposing the surface of objects to a rectangular laser beam through a mask by cutting it off in an intended mark form as is the case with the TEA type carbon dioxide gas laser and the like.

As examples of objects being the subject matter of marking by the method for laser-marking according to the present invention there are cited electron parts, such as condensor, chip resistor, inductor, IC and the like; electric parts, such as connector, case print circuit board and the like; products provided usually with markings such as electric wire, key top, sheet, machine part housing for electric products, note, card and the like; articles being so small that they are incapable of marking by transferring or the like; small articles for which it is necessary to provide a highly precise marking, such as bar cord, and the like.

In order to carry out the laser-marking method of the present invention it is sufficient to form the surface of the marking-intended portion of the composition and expose it to laser beams having wavelengths falling in the far infrared region for marking by such a method as using the composition containing the non-black inorganic lead compound and resin as all or a part of the object, or coating the composition on the surface of the object or printing or coating the composition or forming its multilayer on a part of the surface of the object or sticking tape made of the composition to the surface of the object. According to the present invention it is possible to provide a highly sensitive and highly visible black marking merely by exposure to laser beams.

With the reference to Examples and Comparison Examples the present invention will be explained in more detail hereinafter. In this connection, please note that that parts appearing throughout the examples is in all instances in parts by weight.

EXAMPLE 1

| | |
|---|---|
| Bisphenol F type epoxy resin (epoxy equivalent 180) | 18 parts |
| Acid anhydride type curing agent (acid anhydride equivalent 166) | 15 parts |
| Curing accelerator (benzyldimethylamine) | 0.4 parts |
| Basic lead phosphite | 50 parts |

The epoxy resin composition of said recipe was uniformly mixed by means of 3 roll-mill at normal temperature thereby a molding material was obtained. It was cast 5 mm thick between 2 glass sheets coated with a mold releasing agent and then it was cured at conditions of 80° C. for 5 hours and then 160° C. for 5 hours thereby white testpieces were obtained. Then, these testpieces were exposed to 1 pulse of each laser beams with 2 Joule/cm$^2$ and 4 Joule/cm$^2$ in radiation energy through a predetermined mask using the TEA type carbon dioxide gas laser (wavelength about 10.6 micrometers). The results are shown in Table-1.

EXAMPLE 2

White testpieces were obtained in like manner as in Example 1 except that 25 parts of basic lead phosphite and 25 parts of dimagnesium phosphate (containing crystal water) were used instead of 50 parts of basic lead phosphite, and then they were likewise exposed to laser beams. The results are shown in Table-1.

EXAMPLE 3

White testpieces were obtained in like manner as in Example 1 except that 4 parts of basic lead phosphite and 4 parts of mica were used instead of 50 parts of basic lead phosphite, and then they were likewise exposed to laser beams. The results are shown in Table-1.

COMPARISON EXAMPLE 1

White testpieces were obtained in like manner as in Example 1 except that 50 parts of zinc phosphate was used instead of 50 parts of basic lead phosphite, and then they were likewise exposed to laser beams. The results are shown in Table-1.

EXAMPLE 4

| | |
|---|---|
| Diacrylate of polyethylene glycol with molecular weight 600 | 95 parts |
| Photo-initiator (alpha-hydroxyisobutylphenone) | 5 parts |
| Basic lead sulfite | 25 parts |
| Zinc phosphate (not containing crystal water) | 100 parts |

The composition of said recipe was uniformly mixed in a vibration mill thereby a coating composition was obtained. It was coated 70 micrometer thick on a glass plate by means of bar coater, and then it was cured by exposing to about 600 mJoule/cm$^2$ of ultraviolet rays by means of high pressure mercury lamp thereby white testpieces were obtained. Then they were exposed to the TEA type carbon dioxide gas laser (wavelength about 10.6 micrometers) in like manner as in Example 1. The results are shown in Table-1.)

EXAMPLE 5

White testpieces were obtained in the like manner as in Example 4 except that 60 parts of basic lead sulfite and 40 parts of calcium borate (not containing crystal water) were used instead of 25 parts of basic lead sulfite and 25 parts of zinc phosphate (not containing crystal water), and then they are likewise exposed to laser beams. The results are shown in Table-1.

EXAMPLE 6

White testpieces were obtained in like manner as in Example 4 except that 60 parts of basic lead sulfite and 40 parts of sodium metaborate (containing crystal water) were used instead of 25 parts of basic lead sulfite and 25 part of zinc phosphate (not containing crystal water), and then they were likewise exposed to laser beams. The results are shown in Table-1.

EXAMPLE 7

White testpieces were obtained in like manner as in Example 4 except that 150 parts of lead hydroxide and 50 parts of kaoline (not containing crystal water) 25 parts of zinc phosphate (not containing crystal water), and then they were likewise exposed to laser beams. The results are shown in Table-1.

EXAMPLE 8

White testpieces were obtained in like manner as in Example 4 except that 200 parts of basic lead sulfite and 50 parts of ammonium phosphate (containing crystal water) were used instead of 25 parts of basic lead sulfite and 25 parts of zinc phosphate (not containing crystal water), and then they are likewise exposed to laser beams. The results are shown in Table-1.

EXAMPLE 9

White testpieces were obtained in like manner as in Example 4 except that 60 parts of basic lead sulfite and 40 parts of phosphoric acid type glass powder (composition: $SiO_2/Al_2O_3/B_2O_3/CaO/Na_2O/P_2O_3=8/15/10/7/20/40$) were used instead of 25 parts of basic lead sulfite and 25 parts of zinc phosphate (not containing crystal water), and then they were likewise exposed to laser beams. The results are shown in Table-1.

EXAMPLE 10

White testpieces were obtained in like manner as in Example 4 except that 60 parts of basic lead sulfite and 40 parts of asbestos were used instead of 25 parts of basic lead sulfite and 25 parts of zinc phosphate (not containing crystal water), and then they were likewise exposed to laser beams. The results are shown in Table-1.

EXAMPLE 11

White testpieces were obtained in like manner as in Example 4 except that 60 parts of basic lead sulfite and 40 parts of calcium silicate (containing crystal water) were used instead of 25 parts of basic lead sulfite and 25 parts of zinc phosphate (not containing crystal water), and then they were likewise exposed to laser beams. The results are shown in Table-1.

EXAMPLE 12

Blue testpieces were obtained in like manner as in Example 4 except that 50 parts of basic lead sulfite, 50 arts of sodium metaborate (containing crystal water) and 3 parts of Cobalt Blue (C.I. Pigment Blue 28) were used instead of 25 parts of basic lead sulfite and 25 parts of zinc phosphate (not containing crystal water), and then they were likewise exposed to laser beams. The results are shown in Table-1. Further, the coatings on the testpieces were inferior in flexibility.

EXAMPLE 13

Red testpieces were obtained in like manner as in Example 4 except that 50 parts of basic lead sulfite, 50 parts of sodium metaborate (containing crystal water) and 3 parts of red iron oxide (C. I. Pigment Red 101) were used instead of 25 parts of basic lead sulfite and 25 parts of zinc phosphate (not containing crystal water), and then they were likewise exposed to laser beams. The results are shown in Table-1.

EXAMPLE 14

Yellow testpieces were obtained in like manner as in Example 4 except that 50 parts of basic lead sulfite, 50 parts of sodium metaborate (containing crystal water) and 3 parts of Hansa Yellow (C. I. Pigment Yellow 2) were used instead of 25 parts of basic lead sulfite and 25 parts of zinc phosphate (not containing crystal water), and then they were likewise exposed to laser beams. The results are shown in Table-1.

COMPARISON EXAMPLE 2

White testpieces were obtained in like manner as in Example 4 except that 25 parts of lead oxide and 100 parts of zinc phosphate (not containing crystal water) were used instead of 25 parts of basic lead sulfite and 25 parts of zinc phosphate (not containing crystal water), and then they were likewise exposed to laser beams. The results are shown in Table-1.

COMPARISON EXAMPLE 3

Red testpieces were obtained in like manner as in Example 4 except that 3 parts of red iron oxide (C. I. Pigment Red 101) was used instead of 25 parts of basic lead sulfite and 25 parts of zinc phosphate (not containing crystal water), and then they were likewise exposed to laser beams. The results are shown in Table-1.

EXAMPLE 17

White testpieces were obtained in like manner as in Example 15 except that 86 parts of basic lead sulfate was used instead of 86 parts of basic lead phosphite, and then they were likewise exposed to laser beams. The results are shown in Table-1.

EXAMPLE 18

White testpieces were obtained in like manner as in Example 15 except that 86 parts of lead sulfate was used instead of 86 parts of basic lead phosphite, and then they were likewise exposed to laser beams. The results are shown in Table-1.

TABLE 1

| | Content of inorganic lead compound (%) | Content of inorganic boric acid compound, inorganic phosphoric acid compound and inorganic silicic acid compound (%) | Radiation energy of carbon dioxide gas laser beams | |
|---|---|---|---|---|
| | | | 2 Joule/cm$^2$ | 4 Joule/cm$^2$ |
| Example 1 | 60.0 | 0 | x | ◎ |
| Example 2 | 30.0 | 30.0 | ○ | ○ |
| Example 3 | 9.7 | 9.7 | x | ◎ |
| comparison Example 1 | 0 | 42.8 | x | x |
| Example 4 | 11.1 | 44.4 | ○ | ○ |
| Example 5 | 30.0 | 20.0 | ○ | ○ |
| Example 6 | 30.0 | 20.0 | ◎ | ◎ |
| Example 7 | 50.0 | 16.7 | ○ | ○ |
| Example 8 | 57.1 | 14.3 | ○ | ○ |
| Example 9 | 30.0 | 20.0 | ◎ | ○ |
| Example 10 | 30.0 | 20.0 | ◎ | ○ |
| Example 11 | 30.0 | 20.0 | ○ | ○ |
| Example 12 | 24.6 | 24.6 | ◎ | ○ |
| Example 13 | 24.6 | 24.6 | ◎ | ○ |
| Example 14 | 24.6 | 24.6 | ◎ | ◎ |
| Comparison Example 2 | 0 | 37.5 | x | x |
| Comparison Example 3 | 0 | 0 | x | x |
| Example 15 | 45.0 | 0 | x | ○ |
| Example 16 | 45.0 | 0 | x | ○ |
| Example 17 | 45.0 | 0 | x | ○ |
| Example 18 | 45.0 | 0 | x | ○ |

◎ : Excellent
○ : Good
Δ: somewhat no good
x: No good (no color formation)

EXAMPLE 15

| | |
|---|---|
| Diacylate of polyethylene glycol with molecular weight 600 | 100 parts |
| Photo-initiator (alpha-hydroxyisobutylphenone) | 5 parts |
| Basic lead phosphite | 86 parts |

The composition of said recipe was uniformly mixed in a laboratory mixer thereby a coating composition was obtained. It was coated 70 micrometer thick on a glass plate by means of bar coater and then it was cured by exposing to about 600 mJoule/cm$^2$ of ultraviolet rays by means of high pressure mercury lamp thereby white testpieces were obtained. Then they were exposed to laser beams in like manner as in Example 1. The results are shown in Table-1.

EXAMPLE 16

White testpieces were obtained in like manner as in Example 15 except that 86 parts of basic lead sulfite was used instead of 86 parts of basic lead phosphite, and then they were likewise exposed to laser beams. The results are shown in Table-1.

EXAMPLE 19

| | |
|---|---|
| Diacrylate of polyethylene glycol with molecular weight 600 | 64.5 parts |
| Photo-initiator (alpha-hydroxyisobutylphenone) | 3.2 parts |
| Basic lead sulfite | 32.3 parts |

White testpieces were obtained in like manner as in Example 4 except that the composition of said recipe was used, and then they were likewise exposed to laser beams. The results are shown in Table-2.

EXAMPLE 20

White testpieces obtained in like manner as in Example 19 were exposed to laser beams at 40% output and scanning speed of 300 mm/second by means of scanning type carbon dioxide gas laser (wavelength 10.6 micrometers, output 20W). The results are shown in Table-2.

COMPARISON EXAMPLE 4

White testpieces obtained in like manner as in Example 19 were exposed to laser beams at 10% output and scanning speed of 300 mm/second by means of YAG laser (wavelength 1.06 micrometers, output 70 W). The results are shown in Table-2.

EXAMPLE 21

| | |
|---|---|
| Polyethylene (melt index 200 g/10 min.) | 100 parts |
| Basic lead phosphite | 80 parts |
| Dispersant (zinc stearate) | 1 part |
| Lubricant (stearic acid) | 1 part |

The composition of said recipe was thoroughly mixed at 140° C. in a laboratory blast mill thereby a molding material was obtained. It was molded into 1 mm thick sheets by means of heated press and they were cooled thereby white testpieces were obtained. Then they are likewise exposed to laser beams. The results were shown in Table-2.

EXAMPLE 22

| | |
|---|---|
| Polyethylene (melt index 200 g/10 min.) | 20 parts |
| Basic lead phosphite | 60 parts |
| Silica type glass powder (glass composition: $SiO_2/CaO/MgO/Na_2O$ = 72/10/3/15) | 10 parts |
| Dispersant (zinc stearate) | 1 part |
| Lubricant (stearic acid) | 1 part |

The composition of said recipe was mixed likewise as in Example 21 and molded white testpieces were obtained, and then they were likewise exposed to laser beams. The results are shown in Table-2.

EXAMPLE 23

| | |
|---|---|
| Polyethylene (melt index 200 g/10 min.) | 80 parts |
| Basic lead sulfite | 20 parts |
| Copper Phthalocyanine Green (C.I. Pigment Green 7) | 0.2 part |
| Dispersant (zinc stearate) | 0.2 part |

The composition of said recipe was mixed and molded in like manner as in Example 21 thereby white testpieces were obtained, and then they were likewise exposed to laser beams. The results are shown in Table-2.

COMPARISON EXAMPLE 5

White testpieces were obtained in like manner as in Example 23 except that the addition of 20 parts of basic lead sulfite was omitted, and then they were likewise exposed to laser beams. The results are shown in Table-2.

TABLE 2

| | Content of inorganic lead compound (%) | Content of inorganic boric acid compound, inorganic phosphoric acid compound and inorganic silicic acid compound (%) | Radiation energy of laser beams 2 Joule/cm² | 4 Joule/cm² |
|---|---|---|---|---|
| Example 19 | 32.3 | 0 | ◎ | ◎ |
| Example 20 | 32.3 | 0 | Carbon dioxide gas laser Output: 10 W × 0.5 ◎ | |
| Comparison Example 4 | 32.3 | 0 | YAG laser Output: 70 W × 0.1 Δ | |
| | | | YAG laser Output: 70 W × 0.4 Δ | |
| Example 21 | 44.2 | 0 | ◎ | ◎ |
| Example 22 | 65.2 | 10.9 | ◎ | ◎ |
| Example 23 | 39.5 | 0 | ◎ | ◎ |
| Comparison Example 5 | 0 | 0 | x | x |

◎ : Excellent
○ : Good
Δ: somewhat no good
x: No good (no color formation)

We claim:

1. A method for laser-marking characterized by marking the surface of an object comprising a non-black inorganic lead compound and a resin by exposure to laser beams having wavelengths falling in the far infrared region, wherein the non-black inorganic lead compound is basic lead phosphite and/or basic lead sulfite.

2. A method for laser-marking characterized by marking the surface of an object comprising a non-black inorganic lead compound and a resin by exposure to laser beams having wavelengths falling in the far infrared region, wherein said object further comprises at least one compound selected from inorganic boric acid compounds, inorganic phosphoric acid compounds and inorganic silicic acid compounds together with the non-black inorganic lead compound and the resin.

3. The method of claim 2 in which the inorganic boric acid compound is zinc borate, calcium borate, sodium metaborate or boric acid type glass.

4. The method of claim 2 in which the inorganic phosphoric acid compound is lead phosphite, dimagnesium phosphate, trimagnesium phosphate, dicalcium phosphate, ammonium phosphate or phosphoric acid type glass.

5. The method of claim 2 in which the inorganic silicic acid compound is kaolin, clay, mica, asbestos, calcium silicate, silica or silica type glass.

6. A method for laser-marking characterized by marking the surface of an object comprising a non-black inorganic lead compound and a resin by exposure of laser beams having wavelengths falling in the far infrared region, in which said object is an object obtained by coating the surface with a coating composition containing at least one compound selected from inorganic boric acid compounds, inorganic phosphoric acid compounds and inorganic silicic acid compounds together with the non-black inorganic lead compound and the resin.

7. A method for laser-marking characterized by marking the surface of an object comprising a non-black inorganic lead compound and a resin by exposure to laser beams having wavelengths falling in the far infrared region, in which said object is a shaped article obtained by molding a molding material containing at least one compound selected from inorganic boric acid compounds, inorganic phosphoric acid compounds and inorganic silicic acid compounds together with the non-black inorganic lead compound and the resin.

* * * * *